US005344469A

United States Patent [19]

Tachiki

[11] Patent Number: 5,344,469

[45] Date of Patent: Sep. 6, 1994

[54] GASOLINE-BLENDED METHANOL FUEL FOR INTERNAL COMBUSTION ENGINES

[75] Inventor: Kiyohiro Tachiki, Kanagawa, Japan

[73] Assignee: Mitsubishi Oil Co., Ltd., Tokyo, Japan

[21] Appl. No.: 11,545

[22] Filed: Feb. 1, 1993

[30] Foreign Application Priority Data

Jan. 31, 1992 [JP] Japan ..... 4-040505

[51] Int. Cl.[5] ..... C10L 1/02; C10L 1/04

[52] U.S. Cl. ..... 44/451; 208/16; 208/17

[58] Field of Search ..... 44/451; 208/16, 17

[56] References Cited

U.S. PATENT DOCUMENTS

| | | | |
|---|---|---|---|
| 1,578,201 | 3/1926 | Midgley, Jr. | 44/451 |
| 2,420,030 | 5/1947 | Brandon | 208/17 |
| 2,897,067 | 7/1959 | Sparks et al. | 44/451 |
| 3,330,758 | 7/1967 | Simpson | 208/17 |
| 4,172,812 | 10/1979 | Winter | 208/16 |
| 4,279,619 | 7/1981 | Tsuzriki et al. | 44/451 |
| 4,801,305 | 1/1989 | Muller et al. | 44/451 |
| 5,015,356 | 5/1991 | Talbert | 208/17 |

OTHER PUBLICATIONS

*Proceedings Fifth International Alcohol Fuel Technology Symposium*, vol. II, May 13–18, 1982; Auckland, New Zealand.

*Proceedings Communications*, vol. I, May 21–25, 1984; Ottawa, Canada.

*VIII International Symposium On Alcohol Fuels*, Nov. 13–16, 1988; Tokyo, Japan.

*Primary Examiner*—Margaret Medley

*Attorney, Agent, or Firm*—Sughrue, Mion, Zinn, Macpeak & Seas

[57] ABSTRACT

Disclosed is a fuel for Otto cycle internal combustion engines. The fuel comprises a blend of a gasoline (A) and methanol (B) in a ratio of 10:90 to 30:70 by volume, based on the total volume amount of (A) and (B). Gasoline (A) is obtained by the steps of, (i) selectively hydrotreating a thermally cracked gasoline obtained by thermally cracking petroleum hydrocarbons, (ii) subsequently distilling the thermally cracked gasoline to divide said cracked gasoline into three fractions (1), (2) and (3) which fractions contain hydrocarbons having a carbon number of 5 and less, from 6 to 8, and 9 and more, respectively, and (iii) mixing the two fractions of (1) and (3) either in a ratio which is the same as that in which the two fractions were obtained by the distillation or in a ratio of 50:50 to 90:10 based on the total volume amount of (1) and (3).

3 Claims, No Drawings

GASOLINE-BLENDED METHANOL FUEL FOR INTERNAL COMBUSTION ENGINES

FIELD OF THE INVENTION

The present invention relates to a fuel for internal combustion engines which is obtained by blending a specific gasoline with methanol in order to overcome the drawbacks of methanol as a substitute fuel for use in Otto cycle type internal combustion engines.

BACKGROUND OF THE INVENTION

Gasolines comprising petroleum hydrocarbons have been used for a long time as fuels for Otto cycle type internal combustion engines. However, the oil crises that occurred repeatedly in 1973 and 1979 led to investigations of various fuel substitutes for petroleum. Of these, methanol is expected to be the most promising substitute fuel for use in Otto cycle type internal combustion engines. In the United States, methanol is also regarded as a promising measure against photochemical smog which is a serious cause of urban environmental pollution. For these reasons, experiments on methanol fuels are being made in various countries in the world including the United States and Japan.

However, methanol has the following drawbacks as indicated, for example, in *Proceedings of VIII International Symposium on Alcohol Fuels,* (Nov. 13–16, 1988, Tokyo), pp. 851–868:

(a) at low temperatures, methanol has poor engine-starting performance and may be unable to start the engine;

(b) if methanol catches fire in an accident, the flame is invisible, and this is dangerous;

(c) if methanol leaks out in an accident, the leakage is unnoticed because the odor of methanol is weak, and this is dangerous; and (d) in an enclosed state such as in a fuel tank, ordinary temperatures are within the combustion range for the gaseous phase and, hence there is the danger of fire or explosion.

As an expedient for overcoming these drawbacks, blending of methanol with around 15% by volume of a gasoline or the like is generally done. In this case, automotive gasolines on the general market, catalytically reformed gasolines, straight-run light naphthas, and isopentane are employed as the blending gasoline or the like.

Although blends of methanol with these gasolines or the like have the aforementioned inflammation-avoiding effect (d), blending components respectively have the following problems:

(1) automotive gasolines produce a low temperature starting-improving effect (a), flame visibility-improving effect (b), and odor-imparting effect (c) (referring to the aforementioned drawbacks), but these effects are still insufficient. Further, there are cases where these improving effects are varied by a difference in production method or the lot of the gasolines;

(2) catalytically reformed gasolines are good in (b) but are insufficient in (a) and (c);

(3) straight-run light naphthas are good in (a) but are insufficient in (b) and (c); and (4) isopentane is good in (a) but is insufficient in (b) and (c). Further, it is expensive and is uneconomical.

SUMMARY OF THE INVENTION

An object of the present invention is to provide a gasoline-blended methanol fuel for internal combustion engines which eliminates the problems described above.

According to the present invention, a gasoline containing, as major components, (i) a volatile and strongly odorous fraction which has been obtained from a gasoline base, the hydrocarbons of which have 5 or less carbon atoms and which is effective for improving the aforementioned drawbacks (a) and (c) and (ii) a heavy fraction which has been enriched with aromatic hydrocarbons having 9 or more carbon atoms and is effective for improving the aforementioned drawback (b). The gasoline is blended with methanol thereby to overcome the problems. This blending gasoline comprises fractions of a thermally cracked gasoline that can be obtained economically at low cost without using a special purification method.

The present invention employs a gasoline (A) obtained by selectively hydrotreating a thermally cracked gasoline obtained by thermally cracking petroleum hydrocarbons, subsequently distilling the thermally cracked gasoline to divide it into three fractions (1), (2), and (3), the hydrocarbons of which have a carbon number of 5 and less, from 6 to 8, and 9 and more, respectively, and mixing the two fractions (1) and (3). In this gasoline (A), the proportions of fractions (1) and (3) are either the same as the proportions in which the two fractions were obtained by the distillation, or in a ratio of 50:50 to 90:10 based on the total volume amount of (1) and (3). A blend of the thus-obtained gasoline (A) and methanol (B) in a ratio of 10:90 to 30:70 based on the total volume amount of (A) and (B) is provided by the present invention as a fuel for Otto cycle type internal combustion engines.

DETAILED DESCRIPTION OF THE INVENTION

The petroleum hydrocarbons for use as the raw material to be thermally cracked for producing the fuel of the present invention may be a light naphtha, whole-range-boiling naphtha, gas oil, natural gas condensate, or the like. The thermal cracking of the petroleum hydrocarbons may be conducted by either a tubular cracking furnace method or a heat-transfer-medium cracking method.

The petroleum hydrocarbons described above are thermally cracked at high temperatures of 700° C. or more to produce ethylene and propylene as petrochemical raw materials. In this cracking, a so-called thermally cracked gasoline having a boiling point range of from 30° to 200° C. is obtained as a by-product. This thermally cracked gasoline consists mainly of hydrocarbons having from 4 to 11 carbon atoms, and contains olefins, diolefins, and the like in addition to 50 to 80% by volume of aromatic hydrocarbons such as benzene, toluene, xylenes, and $C_9$ aromatics.

By the selective hydrotreatment of this thermally cracked gasoline, unstable diolefins alone are selectively converted just to monoolefins. The resulting gasoline is then divided by distillation into three fractions (1), (2), and (3), the hydrocarbons of which have carbon numbers of 5 and less, from 6 to 8, and 9 and more, respectively. In general, fraction (2) is further subjected to second-stage hydrotreatment, followed by extraction and precise distillation, thereby to produce benzene, toluene, and xylenes, with the two fractions (1) and (3) being by-products.

The present invention is a fuel for Otto cycle type internal combustion engines which comprises a blend of gasoline (A) obtained by mixing the above-described two fractions of (1) and (3) with methanol (B) in a ratio of 10:90 to 30:70 by volume based on the total amount of (A) and (B).

In this fuel, the proportion of the gasoline (A) should be 10% by volume or more from the standpoint of low temperature starting-improving effect (a), flame visibility-improving effect (b), and odor-imparting effect (c). If the gasoline (A) proportion is below 10% by volume, these effects cannot be produced sufficiently. It should, however, be noted that although larger gasoline proportions do not adversely affect these effects, fuels having too high a gasoline content are of less importance as a gasoline substitute and may be economically disadvantageous. Therefore, a practical range of the proportion of the gasoline (A) is up to about 30% by volume.

In the gasoline (A), the proportions of fractions (1) and (3) are either the same as the proportions in which the two fractions were obtained by distillation, or in a ratio of 50:50 to 90:10 based on the total volume amount of (1) and (3).

Further, a gasoline (A') obtained by mixing an ordinary automotive gasoline base with the gasoline (A) in a proportion of 30:70 by volume or less (based on the total volume amount of blend (A')) may be blended with methanol (B) in a ratio of 10:90 to 30:70 based on the total volume amount of (A') and (B), to give a fuel for Otto cycle type internal combustion engines. The mixing of an ordinary automotive gasoline may reduce improvement for effects (a), (b), and (c), but these inventive effectivenesses remain until the upper additional limit of an ordinary automotive gasoline.

The reasons for the use of fractions (1) and (3) but not fraction (2) are (i) that fraction (1) is effective in improving the low temperature starting-improving effect (a) and odor-imparting effect (c) because it is low in boiling point, volatile, and strongly odorous, and (ii) that fraction (3) is effective in improving the flame visibility-improving effect (b) by the time the methanol fuel burns out because fraction (3) contains a large amount of aromatic hydrocarbons and has a high boiling point. On the other hand, fraction (2), although effective in each of (a), (b), and (c), is less effective than a combination of fractions (1) and (3). A characteristic feature of the present invention resides in that the particularly effective fractions only are used as described above thereby to make the gasoline better than conventional gasolines.

Further, the reason for the limitation of the proportions of fractions (1) and (3), which are either the same as the proportions in which the two fractions were obtained by distillation or in a ratio of 50:50 to 90:10 based on the total volume amount of (1) and (3), is that proportions outside these ranges result in less improvement for effects in (a), (b), and (c).

Furthermore, the reason for the limitation on the amount of gasoline (A') in the present invention, which is one obtained by mixing an ordinary automotive gasoline base with a gasoline (A) in a proportion of 30:70 by volume or less, is that an ordinary automotive gasoline proportion above this range result in less improvement for effects in (a), (b), and (c).

The present invention is characterized in that either a gasoline (A) obtained by mixing the above-described two fractions of (1) and (3) or a gasoline (A') obtained by mixing an automotive gasoline base with the gasoline (A) in a proportion of 30:70 by volume or less of gasoline base, is blended with methanol.

Fraction (1) contains, as major components, olefinic hydrocarbons having from 4 to 5 carbon atoms and, hence, is low in boiling point, volatile, and strongly odorous. Therefore, blending this fraction with methanol significantly improves the low temperature-starting performance of methanol (effect (a)) and odor-imparting effect (c).

Fraction (3) contains, as major components, aromatic hydrocarbons having 9 or more carbon atoms and is high in boiling point. As a result, it is effective in keeping methanol fuel flames bright until the fuel burns out. Therefore, blending of this fraction with methanol significantly improves the visibility of methanol flames (effect (b)).

As described above, by blending either a gasoline (A) obtained by mixing the two fractions of (1) and (3) or a gasoline (A') containing the gasoline (A) as the major component with methanol (B) in a ratio of 10:90 to 30:70, the present invention can overcome all the aforementioned methanol drawbacks (a), (b), and (c) to a higher degree as compared with conventional techniques.

The present invention will be explained below in more detail with reference to the following examples, but the invention is not construed as being limited thereto.

EXAMPLES

The Examples and Comparative Examples are summarized in Tables 1 and 2, respectively.

EXAMPLE 1

Example 1 shows the most preferred embodiment of the fuel of the present invention. A thermally cracked gasoline obtained by thermally cracking a straight-run light naphtha by a tubular cracking furnace method was selectively hydrotreated. Thereafter, the resulting gasoline was divided by distillation into three fractions of (1), (2), and (3) which were 5 and less, from 6 to 8, and 9 and more, respectively, in terms of the carbon atom number of the hydrocarbons contained therein. Fractions (1) and (3) were then mixed with each other in amounts of 55% by volume and 45% by volume, respectively, to prepare a thermally cracked gasoline distillate. This thermally cracked gasoline distillate was blended with methanol in a proportion of 15% by volume, based on the total blend.

The thermally cracked gasoline distillate used for preparing the gasoline-blended methanol fuel had fraction proportions such that the proportion of the fraction of $C_5$ and less was 53% by volume and the proportion of the fraction of $C_9$ and more was 44% by volume, based on the total volume. With respect to the hydrocarbon composition of the distillate, the content of olefins was 45% by volume and the content of aromatics was 43% by volume. The olefins are mainly contained in the fraction of $C_5$ and less and are closely related to the low temperature starting-improving effect and the odor-imparting effect, while the aromatics are mainly contained in the fraction of $C_9$ and more and are closely related to the flame visibility-improving effect.

This gasoline-blended methanol fuel was evaluated for low temperature starting-improving effect, flame visibility-improving effect, and odor-imparting effect. Sufficient improvements were observed in each item.

EXAMPLE 2

Fractions (1) and (3) were mixed with each other in amounts of 80% by volume and 20% by volume, respectively, to prepare a thermally cracked gasoline distillate. This thermally cracked gasoline distillate was blended with methanol in a proportion of 15% by volume, based on the total blend.

The thermally cracked gasoline distillate used for preparing the gasoline-blended methanol fuel had fraction proportions such that the proportion of the fraction of $C_5$ and less was 76% by volume and the proportion of the fraction of $C_9$ and more was 20% by volume. With respect to the hydrocarbon composition of the distillate, the content of olefins was 65% by volume and the content of aromatics was 19% by volume.

This gasoline-blended methanol fuel was evaluated for low temperature starting-improving effect, flame visibility-improving effect, and odor-imparting effect. A significant improvement was observed concerning the low temperature starting-improving effect and the odor-imparting effect, and an almost satisfactory improvement was observed for the flame visibility-improving effect.

EXAMPLE 3

Fractions (1) and (3) were mixed with each other in amounts of 85% by volume and 15% by volume, respectively, to prepare a thermally cracked gasoline distillate. This thermally cracked gasoline distillate was blended with methanol in a proportion of 15% by volume, based on the total blend.

The thermally cracked gasoline distillate used for preparing the gasoline-blended methanol fuel had fraction proportions such that the proportion of the fraction of $C_5$ and less was 81% by volume and the proportion of the fraction of $C_9$ and more was 14% by volume. With respect to the hydrocarbon composition of the distillate, the content of olefins was 70% by volume and the content of aromatics was 13% by volume.

This gasoline-blended methanol fuel was evaluated for low temperature starting-improving effect, flame visibility-improving effect, and odor-imparting effect. A significant improvement was observed concerning the low temperature starting-improving effect and the odor-imparting effect, and an almost satisfactory improvement was observed concerning the flame visibility-improving effect.

EXAMPLE 4

The thermally cracked gasoline distillate obtained in Example 1 was blended with methanol in a proportion of 12% by volume, based on the total blend.

This gasoline-blended methanol fuel was evaluated for low temperature starting-improving effect, flame visibility-improving effect, and odor-imparting effect. A sufficient improvement was observed concerning the low temperature starting-improving effect and the flame visibility-improving effect, and an almost satisfactory improvement was observed for the odor-imparting effect.

EXAMPLE 5

The thermally cracked gasoline distillate obtained in Example 1 was blended with methanol in a proportion of 30% by volume, based on the total blend.

This gasoline-blended methanol fuel was evaluated for low temperature starting-improving effect, flame visibility-improving effect, and odor-imparting effect. A sufficient improvement was observed in each item.

EXAMPLE 6

An ordinary automotive gasoline (regular gasoline on the market) was mixed in an amount of 25% by volume with the thermally cracked gasoline distillate obtained in Example 1, to prepare a gasoline distillate. This gasoline distillate was blended with methanol in a proportion of 15% by volume, based on the total blend.

The gasoline distillate used for preparing the gasoline-blended methanol fuel had fraction proportions such that the proportion of the fraction of $C_5$ and less was 46% by volume and the proportion of the fraction of $C_9$ and more was 38% by volume. With respect to the hydrocarbon composition of the distillate, the content of olefins was 38% by volume and the content of aromatics was 40% by volume.

This gasoline-blended methanol fuel was evaluated for low temperature starting-improving effect, flame visibility-improving effect, and odor-imparting effect. A sufficient improvement was observed concerning the low temperature starting-improving effect and the flame visibility-improving effect, and an almost satisfactory improvement was observed concerning the odor-imparting effect.

COMPARATIVE EXAMPLE 1

An ordinary automotive gasoline was blended with methanol in a proportion of 15% by volume, based on the total blend.

The gasoline distillate used for preparing the gasoline-blended methanol fuel had fraction proportions such that the proportion of the fraction of $C_5$ and less was 23% by volume and the proportion of the fraction of $C_9$ and more was 21% by volume. With respect to the hydrocarbon composition of the distillate, the content of olefins was 16% by volume and the content of aromatics was 29% by volume.

This gasoline-blended methanol fuel was evaluated for low temperature starting-improving effect, flame visibility-improving effect, and odor-imparting effect. Although a certain degree of improvement was observed in each item, the fuel prepared above was less effective than the gasoline-blended methanol fuels according to the present invention.

COMPARATIVE EXAMPLE 2

A straight-run light naphtha was blended with methanol in a proportion of 15% by volume, based on the total blend.

The gasoline distillate used for preparing the gasoline-blended methanol fuel had fraction proportions such that the proportion of the fraction of $C_5$ and less was 42% by volume, but the proportion of the fraction of $C_9$ and more was as 1% by volume. With respect to the hydrocarbon composition of the distillate, the content of olefins was 0% by volume and the content of aromatics was 7% by volume.

This gasoline-blended methanol fuel was evaluated for low temperature starting-improving effect, flame visibility-improving effect, and odor-imparting effect. Although a sufficient improvement was observed on the low temperature starting, the flame visibility-improving effect was insufficient and the odor-imparting effect was extremely poor.

COMPARATIVE EXAMPLE 3

Fractions (1) and (3) were mixed with each other in amounts of 45% by volume and 55% by volume, respectively, to prepare a thermally cracked gasoline distillate. This thermally cracked gasoline distillate was blended with methanol in a proportion of 15% by volume, based on the total blend.

The thermally cracked gasoline distillate used for preparing the gasoline-blended methanol fuel had fraction proportions such that the proportion of the fraction of $C_5$ and less was 43% by volume and the proportion of the fraction of $C_9$ and more was 54% by volume. With respect to the hydrocarbon composition of the distillate, the content of olefins was 37% by volume and the content of aromatics was 52% by volume.

This gasoline-blended methanol fuel was evaluated for low temperature starting-improving effect, flame visibility-improving effect, and odor-imparting effect. Although a sufficient improvement was observed concerning the flame visibility-improving effect, the fuel prepared above was less effective in the low temperature starting-improving effect and the odor-imparting effect than the gasoline-blended methanol fuels according to the present invention.

COMPARATIVE EXAMPLE 4

Fractions (1) and (3) were mixed with each other in amounts of 95% and 5% by volume, respectively, to prepare a thermally cracked gasoline distillate. This thermally cracked gasoline distillate was blended with methanol in a proportion of 15% by volume, based on the total blend. The thermally cracked gasoline distillate used for preparing the gasoline-blended methanol fuel had fraction proportions such that the proportion of the fraction of $C_5$ and less was 90% by volume and the proportion of the fraction of $C_9$ and more was 5% by volume. With respect to the hydrocarbon composition of the distillate, the content of olefins was 76% by volume and the content of aromatics was 5% by volume.

This gasoline-blended methanol fuel was evaluated for low temperature starting-improving effect, flame visibility-improving effect, and odor-imparting effect. Although a sufficient improvement was observed concerning the low temperature starting-improving effect and the odor-imparting effect, the flame visibility-improving effect was quite insufficient.

COMPARATIVE EXAMPLE 5

The thermally cracked gasoline distillate obtained in Example 1 was blended with methanol in a proportion of 8% by volume, based on the total blend.

This gasoline-blended methanol fuel was evaluated for low temperature starting-improving effect, flame visibility-improving effect, and odor-imparting effect. Although a certain degree of improvement was observed in each item, the fuel prepared above was less effective than the gasoline-blended methanol fuels according to the present invention.

COMPARATIVE EXAMPLE 6

An ordinary automotive gasoline (regular gasoline on the market) was mixed in an amount of 35% by volume with the thermally cracked gasoline distillate obtained in Example 1, to prepare a gasoline distillate. This gasoline distillate was blended with methanol in a proportion of 15% by volume, based on the total blend.

This gasoline-blended methanol fuel was evaluated for low temperature starting-improving effect, flame visibility-improving effect, and odor-imparting effect. Although a sufficient improvement was observed concerning the flame visibility-improving effect, the fuel prepared above was less effective in the low temperature starting-improving effect and the odor-imparting effect than the gasoline-blended methanol fuels according to the present invention.

TABLE 1

| | Example | | | | | |
|---|---|---|---|---|---|---|
| | 1 | 2 | 3 | 4 | 5 | 6 |
| Base ingredients | | | | | | |
| Methanol, vol % | 85 | 85 | 85 | 88 | 70 | 85 |
| Thermally cracked gasoline fraction (1), vol % | 8.25 (55) | 12.00 (80) | 12.75 (85) | 6.60 (55) | 16.50 (55) | 6.19 (55) 11.25 (75) |
| Thermally cracked gasoline fraction (3), vol % | 6.75 (45) | 3.00 (20) | 2.25 (15) | 5.40 (45) | 13.50 (45) | 5.06 (45) 11.25 (75) |
| Ordinary automotive gasoline base, vol % | — | — | — | — | — | 3.75 (25) |
| Contents in whole gasoline | | | | | | |
| Fraction of $C_5$ and less, vol % | 53 | 76 | 81 | 53 | 53 | 46 |
| Fraction of $C_{6-8}$, vol % | 3 | 4 | 5 | 3 | 3 | 16 |
| Fraction of $C_9$ and more, vol % | 44 | 20 | 14 | 44 | 44 | 38 |
| Olefins, vol % | 45 | 65 | 70 | 45 | 45 | 38 |
| Aromatics, vol % | 43 | 19 | 13 | 43 | 43 | 40 |
| Low temperature starting-improving effect (a) | ◎ | ◎ | ◎ | ◎ | ◎ | ◎ |
| Flame visibility-improving effect (b) | ◎ | ○ | ○ | ◎ | ◎ | ◎ |
| Odor-imparting effect (c) | ◎ | ◎ | ◎ | ○ | ◎ | ○ |

TABLE 2

| | Comparative Example | | | | | |
|---|---|---|---|---|---|---|
| | 1 | 2 | 3 | 4 | 5 | 6 |
| Base ingredients | | | | | | |
| Methanol, vol % | 85 | 85 | 85 | 85 | 92 | 85 |

TABLE 2-continued

| | Comparative Example | | | | | | |
|---|---|---|---|---|---|---|---|
| | 1 | 2 | 3 | 4 | 5 | 6 | |
| Thermally cracked gasoline fraction (1), vol % | — | — | 6.75 (45) | 14.25 (95) | 4.40 (55) | 5.36 (55) | 9.75 (65) |
| Thermally cracked gasoline fraction (3), vol % | — | — | 8.25 (55) | 0.75 (5) | 3.60 (45) | 4.39 (45) | |
| Ordinary automotive gasoline base, vol % | 15 | — | — | — | — | 5.25 (35) | |
| Straight-run light naphtha, vol % | — | 15 | — | — | — | — | |
| Contents in whole gasoline | | | | | | | |
| Fraction of $C_5$ and less, vol % | 23 | 42 | 43 | 90 | 53 | 42 | |
| Fraction of $C_{6-8}$, vol % | 56 | 57 | 3 | 5 | 3 | 22 | |
| Fraction of $C_9$ and more, vol % | 21 | 1 | 54 | 5 | 44 | 36 | |
| Olefins, vol % | 16 | 0 | 37 | 76 | 45 | 35 | |
| Aromatics, vol % | 29 | 7 | 52 | 5 | 43 | 38 | |
| Low temperature starting-improving effect (a) | ○ | ◎ | ○ | ◎ | ○ | ○ | |
| Flame visibility-improving effect (b) | ○ | Δ | ◎ | X | ○ | ◎ | |
| Odor-imparting effect (c) | ○ | X | ○ | ◎ | ○ | ○ | |

In both tables, the uppermost section shows the proportions of base ingredients in the production of each methanol fuel. Figures in parentheses show the percentage of each gasoline fraction by volume based on whole gasoline fractions. The intermediate section shows the distribution of the above-described three fractions and the contents of aromatics and olefins in each whole gasoline. The lowermost section shows evaluation results for each fuel.

Regarding the evaluation results, the low temperature starting-improving effect (a) was evaluated by a test in which a 2.0 L engine which had been altered so as to be suitable for methanol was installed in a low temperature testing room. The temperature at which each fuel was able to start the engine by 10-second cranking was measured. Fuels for which this temperature is below −15° C. are shown by ◎, those between −15° C. and −5° C. by ○, those between −5° C. and 5° C. by Δ, and those of 5° C. or more by x.

With respect to the flame visibility-improving effect (b), evaluation was made by a test in which 10 ml of each fuel was placed in a laboratory dish made of glass which had a diameter of 10 cm and a height of 2 cm. Flame visibility was visually examined in a well-lighted room. Fuels whose flames were fully visible until burning out are shown by ◎, fuels whose flames were visible until burning out are shown by ○, fuels whose flames were visible for a short time after firing but become less visible thereafter were shown by Δ, and fuels whose flames were visible for a short time after firing but become invisible thereafter or whose flames were invisible from the beginning are shown by x .

Further, with respect to odor-imparting effect (c), detection threshold values were measured by a scent bag method (standardized by Odor Research and Engineering Association of Japan). Fuels whose detection threshold values were below 1/100 that of methanol are shown by ◎, those of below 1/30 by ○, those of below 1/10 by Δ, and those of 1/10 or more by x.

Among the Comparative Examples shown in Table 2, the fuel of Comparative Example 1 was one obtained by blending an ordinary automotive gasoline (regular gasoline on the market) with methanol in a proportion of 15% by volume and is widely used as a methanol fuel. The fuel of Comparative Example 2 was one obtained by blending a straight-run light naphtha with methanol in a proportion of 15% by volume and is only occasionally used as a methanol fuel.

While the invention has been described in detail and with reference to specific embodiments thereof, it will be apparent to one skilled in the art that various changes and modifications can be made therein without departing from the spirit and scope thereof.

What is claimed is:

1. A fuel for Otto cycle internal combustion engines, which comprises, a blend of a gasoline (A) and methanol (B) in a ratio of 10:90 to 30:70 by volume, based on the total volume amount of (A) and (B), said gasoline (A) is obtained by the steps of, (i) selectively hydrotreating a thermally cracked gasoline obtained by thermally cracking petroleum hydrocarbons, (ii) subsequently distilling the thermally cracked gasoline to divide said cracked gasoline into three fractions (1), (2) and (3) which fractions contain hydrocarbons having a carbon number of 5 and less, from 6 to 8, and 9 and more, respectively, and (iii) mixing the two fractions of (1) and (3) either in a ratio which is the same as that in which the two fractions were obtained by the distillation or in a ratio of 50:50 to 90:10 based on the total volume amount of (1) and (3).

2. A fuel for Otto cycle internal combustion engines, which comprises, a blend of a gasoline (A') and methanol (B) in a ratio of 10:90 to 30:70, said gasoline (A') is obtained by mixing an ordinary automotive gasoline base with the gasoline (A) as specified in claim 1 in a proportion of 30:70 by volume or less based on the total volume amount of blend (A').

3. A fuel for Otto cycle internal combustion engines, which comprises, a blend of a gasoline (A) and methanol (B) in a ratio of 15:85 by volume, based on the total volume amount of (A) and (B), said gasoline (A) is obtained by the steps of, (i) and (ii) as specified in claim 1, and (iii) mixing the two fractions of (1) and (3) in a ratio of 55:45 based on the total volume amount of (1) and (3).

* * * * *